US011933107B2

(12) United States Patent
Claesson et al.

(10) Patent No.: US 11,933,107 B2
(45) Date of Patent: Mar. 19, 2024

(54) DISC CUTTER FOR UNDERCUTTING APPARATUS AND A METHOD OF MANUFACTURE THEREOF

(71) Applicant: SANDVIK MINING AND CONSTRUCTION TOOLS AB, Sandviken (SE)

(72) Inventors: Bjorn Claesson, Sandviken (SE); Stefan Ederyd, Saltsjo-Boo (SE); Johan Sundstrom, Stockholm (SE); Tomas Berglund, Falun (SE); Fredrik Meurling, Gavle (SE)

(73) Assignee: Sandvik Mining and Construction Tools AB, Sandviken (SE)

( * ) Notice: Subject to any disclaimer, the term of this patent is extended or adjusted under 35 U.S.C. 154(b) by 365 days.

(21) Appl. No.: 17/295,772

(22) PCT Filed: Oct. 31, 2019

(86) PCT No.: PCT/EP2019/079756

§ 371 (c)(1),
(2) Date: May 20, 2021

(87) PCT Pub. No.: WO2020/104162

PCT Pub. Date: May 28, 2020

(65) Prior Publication Data

US 2022/0010627 A1 Jan. 13, 2022

(30) Foreign Application Priority Data

Nov. 23, 2018 (EP) ..... 18208080

(51) Int. Cl.
*E21B 10/12* (2006.01)
*B22F 3/14* (2006.01)
(Continued)

(52) U.S. Cl.
CPC ..... *E21B 10/12* (2013.01); *B22F 3/14* (2013.01); *B22F 7/08* (2013.01); *C22C 9/00* (2013.01);
(Continued)

(58) Field of Classification Search
CPC ..... E21B 10/12; E21B 25/18
See application file for complete search history.

(56) References Cited

U.S. PATENT DOCUMENTS 2,608,753 A * 9/1952 Mooradian ..... B23K 35/007 428/673
4,004,645 A 1/1977 Rees et al.
(Continued)

FOREIGN PATENT DOCUMENTS

CN 201363152 Y 12/2009
EP 0090658 A2 10/1983
(Continued)

*Primary Examiner* — Cathleen R Hutchins
(74) *Attorney, Agent, or Firm* — Corinne R. Gorski

(57) ABSTRACT

A disc cutter for a cutting unit used in an undercutting operation and a method of producing the same. The disc cutter including an annular disc body made of a metal alloy or metal matrix composite having a first side, a second side arranged substantially opposite to the first side and a radially peripheral part. At least one metal alloy, metal matrix composite or cemented carbide cutting part is mounted in and substantially encircling the radially peripheral part of the disc body which protrudes outwardly therefrom to engage with the rock during the mining operation. The at least one cutting part is made from a material having a higher wear resistance than the material used for the disc body, wherein the disc body and the cutting part are joined by diffusion bonds.

15 Claims, 13 Drawing Sheets

Figure 1:
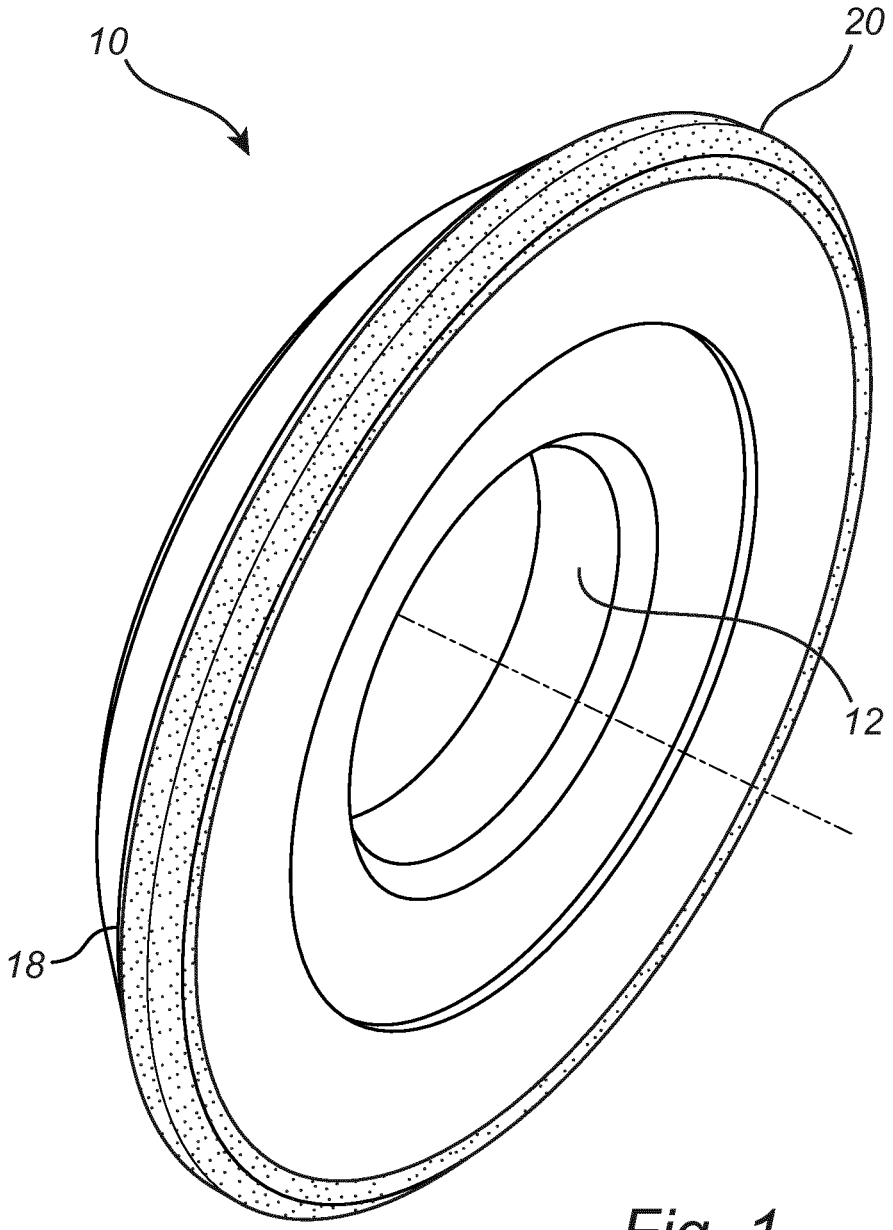

(51) Int. Cl.

| | |
|---|---|
| ***B22F 7/08*** | (2006.01) |
| ***C22C 9/00*** | (2006.01) |
| ***C22C 19/03*** | (2006.01) |
| ***C22C 29/02*** | (2006.01) |
| ***E21B 10/573*** | (2006.01) |
| ***E21C 27/22*** | (2006.01) |
| *B22F 5/00* | (2006.01) |

(52) U.S. Cl.

CPC ..... *C22C 19/03* (2013.01); *C22C 29/02* (2013.01); *E21B 10/573* (2013.01); *E21C 27/22* (2013.01); *B22F 2005/001* (2013.01); *B22F 2998/10* (2013.01)

(56) References Cited

U.S. PATENT DOCUMENTS

| | | | | |
|---|---|---|---|---|
| 4,793,427 | A | 12/1988 | Lambson et al. | |
| 4,907,665 | A | 3/1990 | Kar et al. | |
| 5,904,211 | A * | 5/1999 | Friant ..... | E21D 9/0879 175/371 |
| 6,868,848 | B2 | 3/2005 | Boland et al. | |
| 8,469,458 | B2 | 6/2013 | Bechem et al. | |
| 10,099,300 | B2 | 10/2018 | Stadtfeld et al. | |
| 2014/0251696 | A1 | 9/2014 | Cox | |

FOREIGN PATENT DOCUMENTS

| | | | |
|---|---|---|---|
| GB | 2184382 | A | 6/1987 |
| RU | 2470745 | C2 | 12/2012 |
| RU | 2494252 | C2 | 9/2013 |
| SU | 46594 | A1 | 4/1936 |
| SU | 1765386 | A1 | 9/1992 |

* cited by examiner

DISC CUTTER FOR UNDERCUTTING APPARATUS AND A METHOD OF MANUFACTURE THEREOF

RELATED APPLICATION DATA

This application is a § 371 National Stage Application of PCT International Application No. PCT/EP2019/079756 filed Oct. 31, 2019 claiming priority to EP 18208080.4 filed Nov. 23, 2018.

TECHNOLOGY FIELD

The present invention relates to rock cutting apparatus suitable for creating tunnels or subterranean roadways and in particular to undercutting apparatus wherein the at least one cutting part is joined to the disc body by diffusion bonds.

BACKGROUND

Cutting discs are used for cutting rock in applications such as making tunnels and in mining applications and are used to cut different types of rock formation. Undercutting is type of rock cutting characterized by the tool attacking the rock at an inclined angle, thus utilising an additional free face to enhance chip formation and the loosening of the rock under the tool. Undercutting apparatus is a type of rock cutting apparatus whereby a plurality of rotating heads is capable of being slewed laterally outwards and can be raised in a sideways, upward and downward direction during cutting. The apparatus is particularly well suited to rapid mine development systems (RMDS), reef mining, oscillating disc cutting (ODC) and actuated disc cutting (ADC). Typically, cutting discs are made of hardened steel, but if the rock formation being cut is very hard then the cutting discs will wear out quickly. Attempts to overcome this problem have been made by mechanically attaching at least one cutting part made from a material having a higher wear resistance, such as cemented carbide, to a steel disc body. The cemented carbide cutting parts are joined to the steel disc body mechanically via press fitting or are brazed into position.

U.S. Pat. No. 8,469,458B discloses a roller drill bit for removing material according to the cutting principle wherein the cutting face is made of a harder material than the supporting body. U.S. Pat. No. 4,004,645A1 and U.S. Pat. No. 4,793,427A1 show examples where the cutting parts are mechanically joined together.

However, there remains a problem that, especially for cutting hard or high abrasive rock formations, as the disc cutters are rotating, high forces that are exerted onto the cutting parts of the discs. The high forces exert immense stress on the cutting part and on the joints between the cutting part and the disc body. These forces can cause the cutting part(s) to twist, break or wear out unfavourably quickly. As cemented carbide cutting parts are more expensive than steel cutting parts, there needs to be an improvement in the performance in order to compensate for the additional cost. Therefore, if the cutting discs fails prematurely at the joint between the disc body and the cutting part, then it would be prohibitively expensive to use cemented carbide as the cutting part(s). There is the need for a disc cutter having a harder, more wear resistant cutting part, wherein the cutting part(s), the disc body and the joints between are strong enough to survive when subjected to high loads, whilst still meeting the size and compositional requirements of the disc cutter for the undercutting application. In known designs for disc cutters used for undercutting, the cutting part could be in the form of buttons or wear pads.

Disc cutters having discrete cutting parts, such as buttons, are currently limited to designs that have a significantly high contact area between the cutting part(s) and the disc body. This creates a trade-off between the size of the cutting member and joint design, which with currently known methods of mechanically joining the cutter part(s) to the disc body can create fractures or detachment at the joints and consequently a premature failure of the cutting disc. This is especially the case when undercutting, wherein roller bits or roller bits have a conically widened cutting face on the one side, this cutting face is applied obliquely to the rock face to be removed, therefore extremely high axial forces are exerted to the cutting edge. Therefore, the problem to be solved is to form a disc cutter that has a higher mechanical strength in the joints between the disc body and the cutting part(s) to increase the working lifetime of the disc cutter.

In other applications, such as tunnel boring, where the size of the disc cutters is larger the cutting part may also be in the form if a continuous ring. However, due to the size restriction of the disc cutters used for undercutting, there is insufficient room for the mechanical attachment required to join a cutting part that is in the form of a continuous ring. Therefore, there is also a problem of how to enable the cutting part to be in the form of a continuous ring for disc cutters used for undercutting discs.

Another problem with the current designs is that as a relatively large volume of steel is required in the disc body to hold the cutting part(s) in place, consequently there is limited space available for the fragments of crushed rock to collect after being cut which results in higher rotating forces and stresses being exerted onto the head of the drill bit which will reduce its lifetime. Therefore, a further problem to be solved is how to form a disc cutter having a strong joint between the cutter part(s) and the disc body without having to increase the size of the disc body.

SUMMARY

The present disclosure therefore relates to a disc cutter for a cutting unit used in an undercutting application comprising: an annular disc body made of a metal alloy or metal matrix composite having a first side, a second side arranged substantially opposite to the first side and a radially peripheral part; and at least one metal alloy, metal matrix composite or cemented carbide cutting part mounted in and substantially encircling the radially peripheral part of the disc body which protrudes outwardly therefrom to engage with the rock during operation;

wherein the at least one cutting part is made from a material having a higher wear resistance than the material used for the disc body;

characterized the least one disc body and the at least one cutting part are joined together by diffusion bonds.

The advantage of the present disclosure is that a cutting disc is formed having a high wear resistant edge and a high strength mechanical joint between the at least one disc body and the at least one cutting part. The improvement in the mechanical strength of the joint will improve the lifetime of the cutting disc in the undercutting application. As the strength of the joint between the cutting disc and the cutting part has been improved, the contact area between the two parts does not need to be as high, therefore a further advantage is that is possible to increase the ratio of the volume of the cutting part compared to the volume of the disc body, thereby improving the cutting efficiency of the disc cutter. Another advantage of the present disclosure is that the volume of higher wear resistant material in the cutting part can be increased, therefore improving the overall wear resistance of the disc cutter. Alternatively, the design of the disc cutter could be made smaller and still maintain the same cutting performance. This will provide the advantage that there is more room for the removal of fragments of crushed rock, which will reduce the rotating force and stress on head of the drill bit and therefore increase the lifetime of the drill bit. By increasing the strength of the joint between the cutting part and a disc body it is possible to apply higher loads and it is possible to increase the penetration depth and lifetime of the disc cutter. This means that fewer stoppages are required for repair or replacement of the disc cutters and so continuous cutting is possible for longer, which will ultimately result in an increase in profitability.

In preferred embodiments there is a metallic interlayer between at the least one disc body and the at least one cutting part, the elements of which form the diffusion bonds. The advantage of this is that a stronger diffusion bond is formed between disc body and the at least one cutting part.

In preferred embodiments, the metallic interlayer essentially comprises nickel, nickel alloy, copper or copper alloy. The advantage of this is that a stronger diffusion bond is formed between disc body and the at least one cutting part.

In preferred embodiments, the metallic interlayer comprises an alloy essentially consisting of copper and nickel. The advantage of this is that a strong diffusion bond is formed between the disc body and the at least one cutting part. The metallic interlayer will provide for that the diffusion of carbon between the disc body and the at least one cutting part will be low due to the low solubility for carbon in the metallic interlayer at the processing temperatures in question, hence the metallic interlayer will be acting as a migration barrier or a choke for the migration of carbon atoms between the metal alloy or of metal matrix alloy in the disc body and the metal alloy, MMC or cemented carbide in the cutting part without impairing the ductility of the diffusion bond between the two parts.

In preferred embodiments, the metallic interlayer has a thickness of from about 50 to about 500 μm. It is advantageous for the metallic interlayer to have a thickness in this range to for both effectiveness and ease of manufacturing.

According to one aspect of the present disclosure, the at least one cutting part comprises a cemented carbide. This is advantageous as cemented carbide is highly wear resistant.

According to one aspect of the present disclosure, the at least one cutting part comprising a metal alloy.

According to one aspect of the present disclosure, the at least one cutting part is the form of a plurality of buttons or wear pads. These types of cutting parts are advantageous where increased point loading and lower rolling resistance are preferred during operation.

According to one aspect of the present disclosure, the at least one cutting part is in the form of a continuous ring. This advantageously provides a continuous cutting edge.

According to one aspect of the present disclosure, the disc body comprises at least two layers. This provides the benefit of being able to fix a continuous ring securely in place.

According to one aspect of the present disclosure, the disc body comprises a first layer and a second layer, wherein the first layer comprises a metal or metal matrix composite with a higher wear resistance than the second layer. This provides the advantage of being able to use a more wear resistant grade of material on the side of the disc cutter that is exposed to the rock and a cheaper grade of materials that is not. Post HIP the at least two layers will be joined together to form a unitary body.

The present disclosure further relates to a method for manufacturing a disc cutter for a cutting unit used undercutting applications comprising an annular disc body made of a metal alloy or metal matrix composite having a first side, a second side arranged substantially opposite to the first side and a radially peripheral part; and at least one metal alloy, metal matrix composite or cemented carbide cutting part mounted in and substantially encircling the radially peripheral part of the disc body which protrudes outwardly therefrom to engage with the rock during the mining operation; comprising the steps of:

a) providing at least one disc body made of a metal alloy or at least one disc body made of a metal matrix composite and at least one metal alloy cutting part or at least one metal matrix composite cutting part or at least one cemented carbide cutting part;
b) assembling the at least one disc body and at least one cutting part together;
c) enclosing the at least one disc body and the at least one cutting part in a capsule;
d) optionally evacuating air from the capsule;
e) sealing the capsule;
f) subjecting the capsule to a predetermined temperature of above about 1000° C. and a predetermined pressure of from about 300 bar to about 1500 bar during a predetermined time.

A further advantage of the present invention is that it enables the cutting part to be in the form of a continuous ring. This provides the benefit that a higher area of the cutting part is in contact with the rock, meaning that the cutting part will keep its required shape and sharpness for longer and consequently the cutting efficiency is improved.

In preferred embodiments, there is additional step between a) and b) of positioning a metallic interlayer between each of the surface(s) of each of the disc body and each of surface(s) of the cutting parts. This provides the advantage of improving the mechanical strength of the joint between the disc cutter and the at least one cutting part.

In preferred embodiments, the metallic interlayer essentially comprises nickel, nickel alloy, copper or copper alloy. The advantage of this is that a strong diffusion bond is formed between disc body and the at least one cutting part.

In preferred embodiments, the metallic interlayer is formed by an alloy essentially consisting of copper and nickel. The advantage of this is that a strong diffusion bond is formed between disc body and the at least one cutting part.

According to one aspect of the present disclosure, the metallic interlayer is formed from a foil or a powder.

According to one aspect of the present disclosure, the metallic interlayer is formed by electrolytic plating.

In preferred embodiment, grooves are added to the surface (s) of the at least one cutting part or to the surface(s) of both the at least one annular body and to the surface(s) of the at least one cutting part. This provides the advantage of increasing the surface contact area between the cutting disc and the at least one cutting part, which will increase the strength of the joint.

The present disclosure further relates to the use of the disc cutter according as disclosed hereinbefore or hereinafter for reef mining, rapid mine development systems, oscillating disc cutting or actuated disc cutting.

FIGURES

FIG. 1: Perspective view of a disc cutter for use in undercutting.

Figure 2:
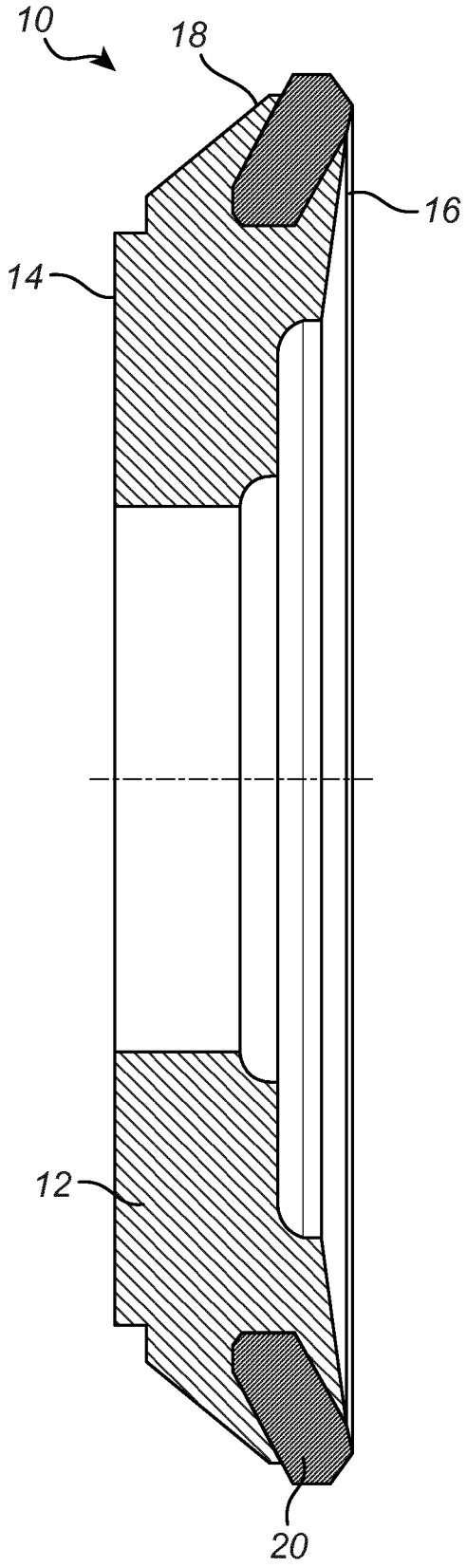

FIG. 2: Cross section of a disc cutter for use in undercutting.

Figure 3:
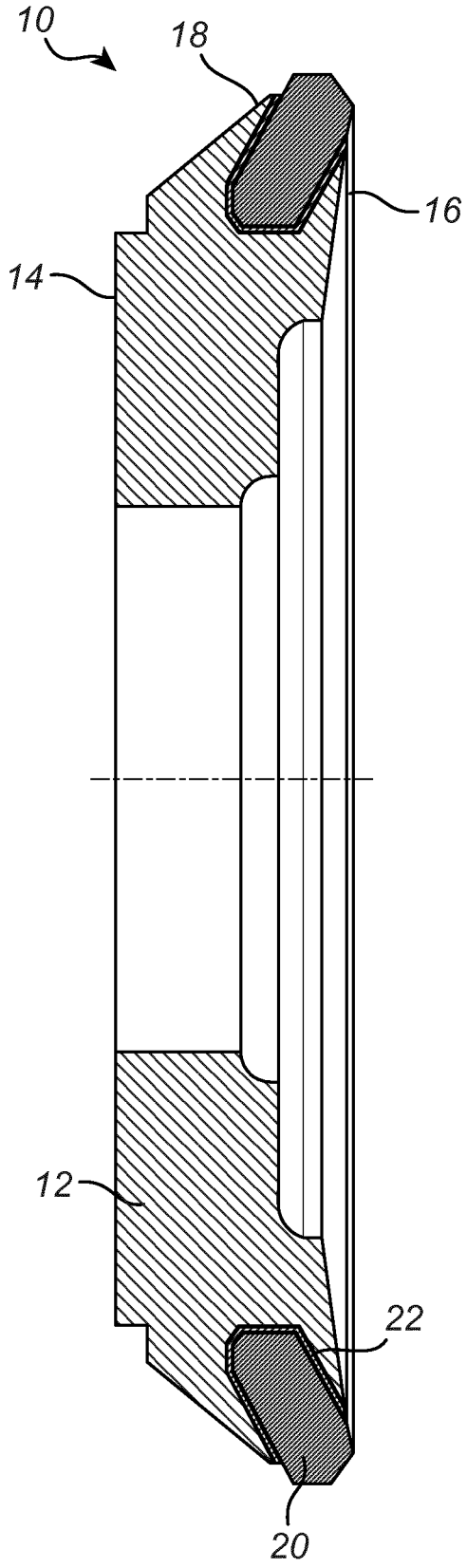

FIG. 3: Cross section of disc cutter for use in undercutting with the inclusion of a metallic interlayer.

Figure 4:
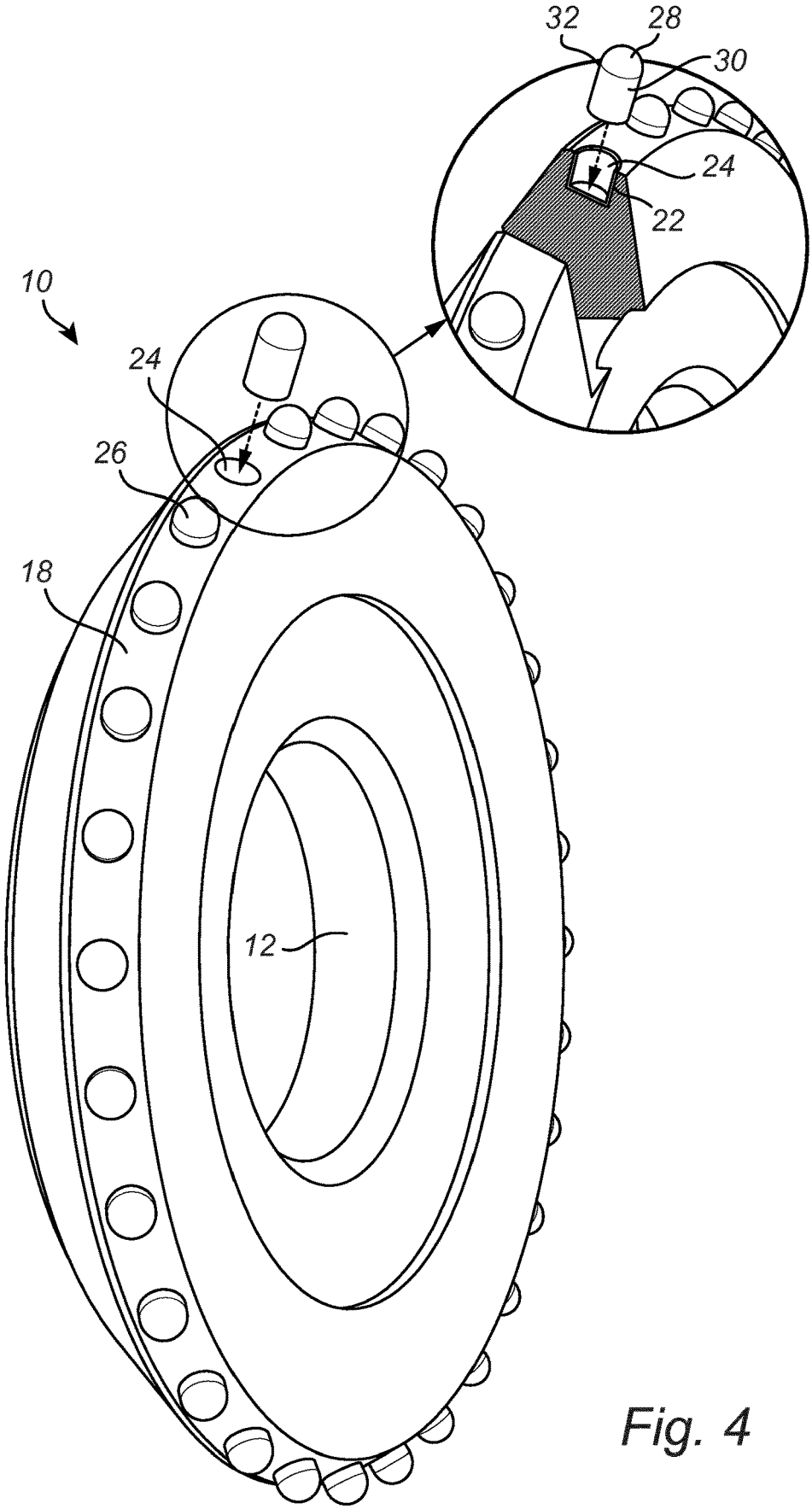

FIG. 4: Perspective view of the disc cutter having recesses drilled into the peripheral edge of the disc body wherein the at least one cutting part is a plurality of buttons.

Figure 5:
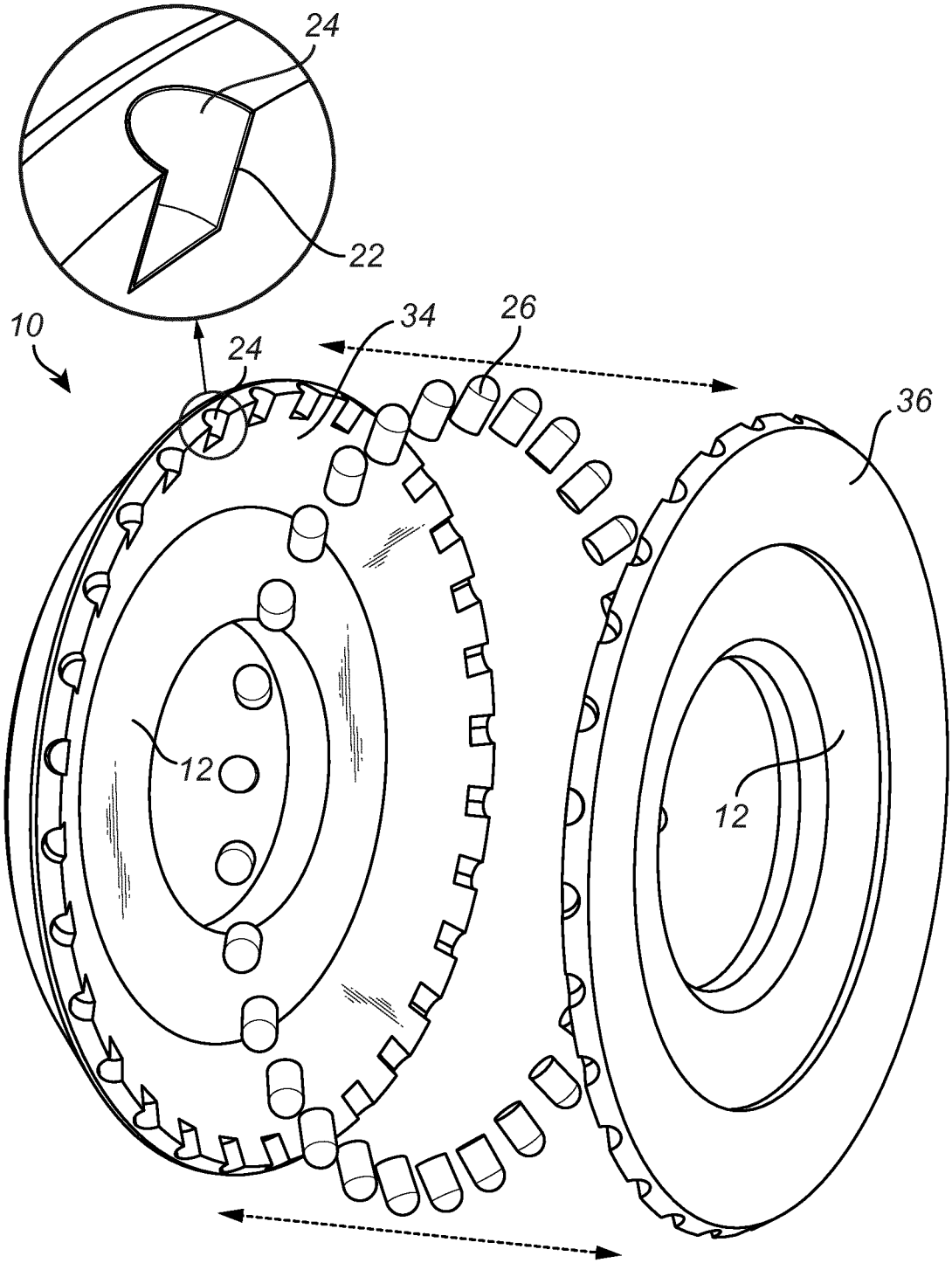

FIG. 5: Perspective view of the disc cutter having two layers wherein the at least one cutting part is a plurality of buttons.

Figure 6:
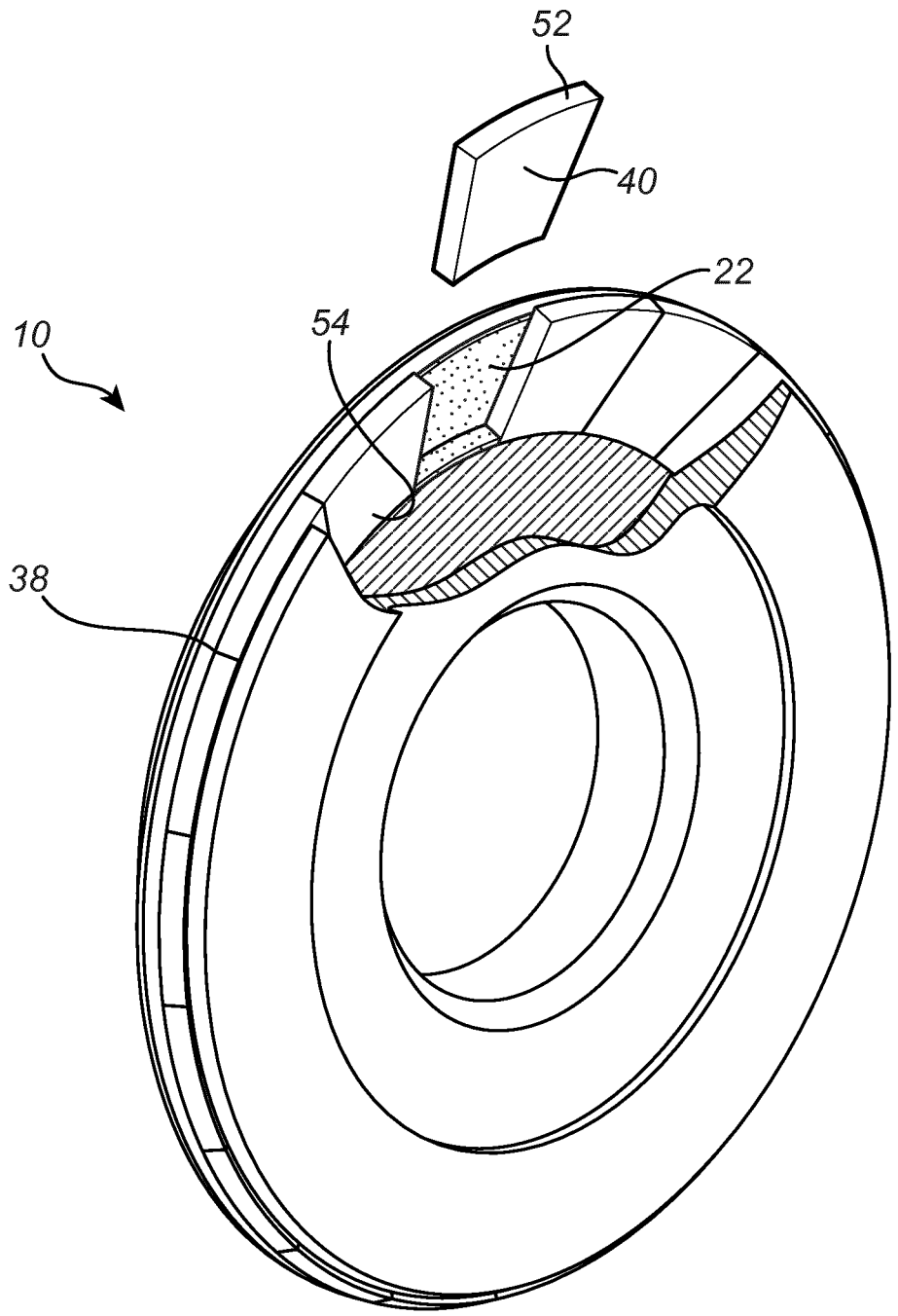

FIG. 6: Perspective view of a disc cutter with wear pads, arranged such that the neighbouring side of adjacent wear pads are in contact.

Figure 7:
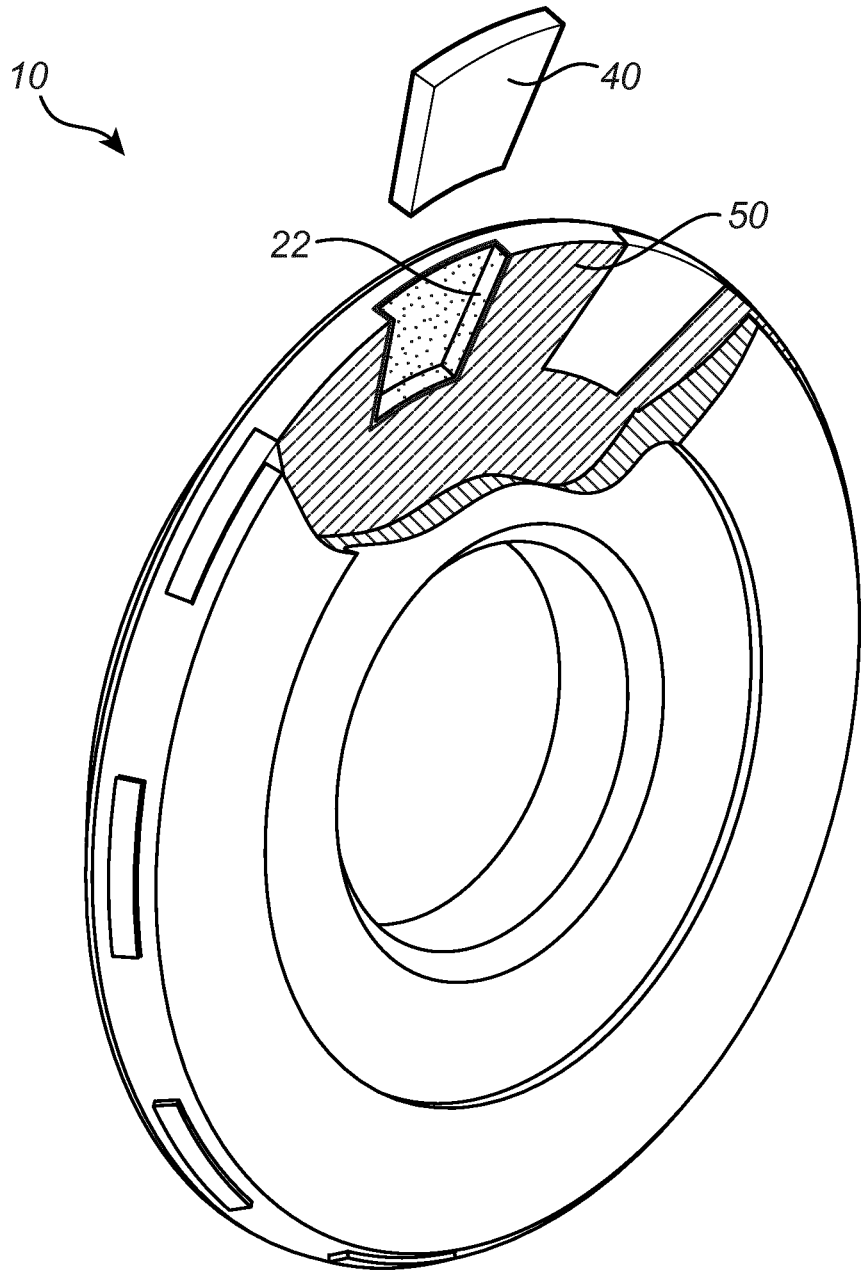

FIG. 7: Perspective view of a disc cutter with wear pads, arranged such that there are gaps between adjacent wear pads.

Figure 8:
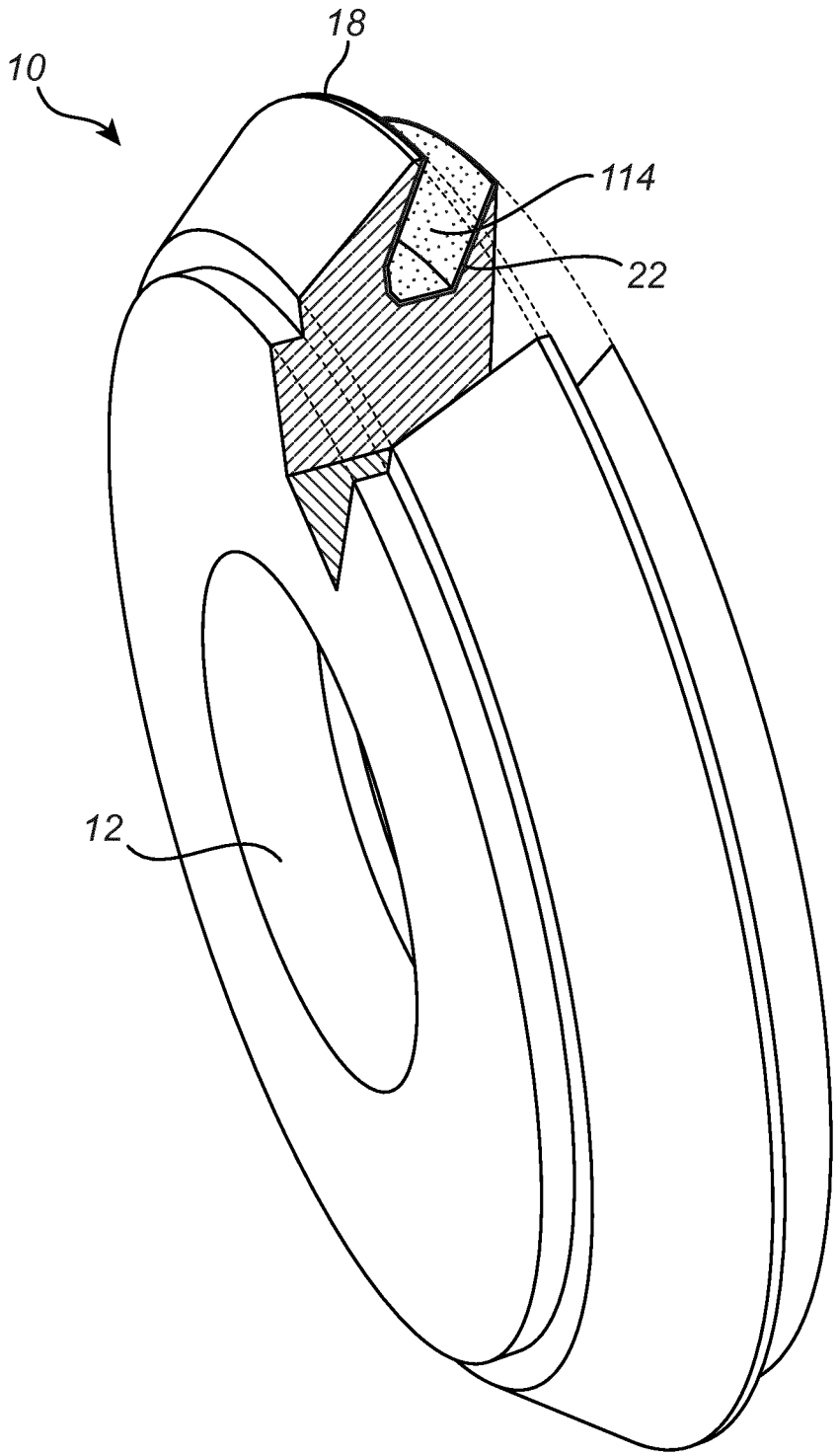

FIG. 8: Perspective view of the disc cutter with a groove for inserting the wear pads.

Figure 9:
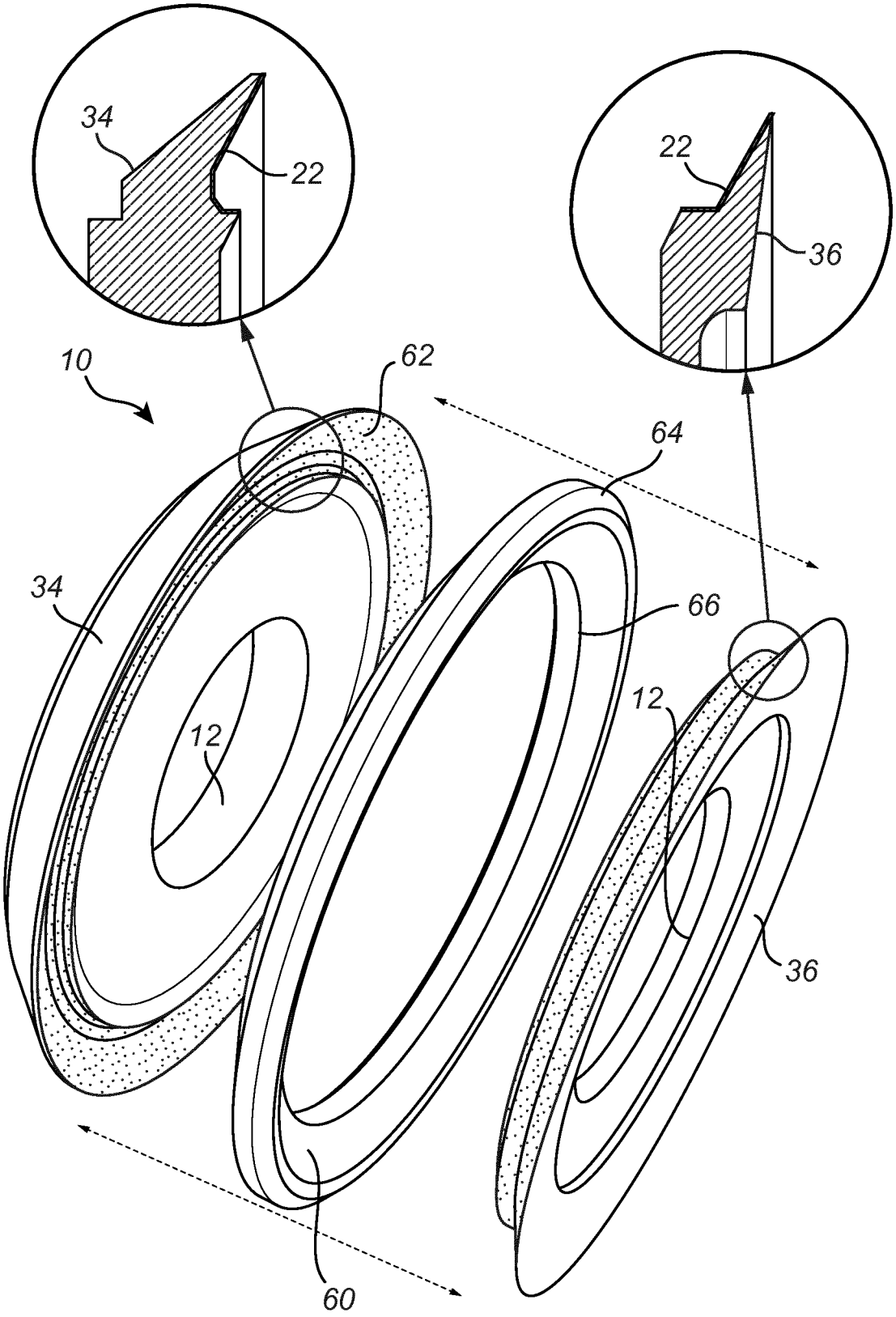

FIG. 9: Perspective view of the disc cutter having two layers to sandwich the continuous ring in-between.

Figure 10:
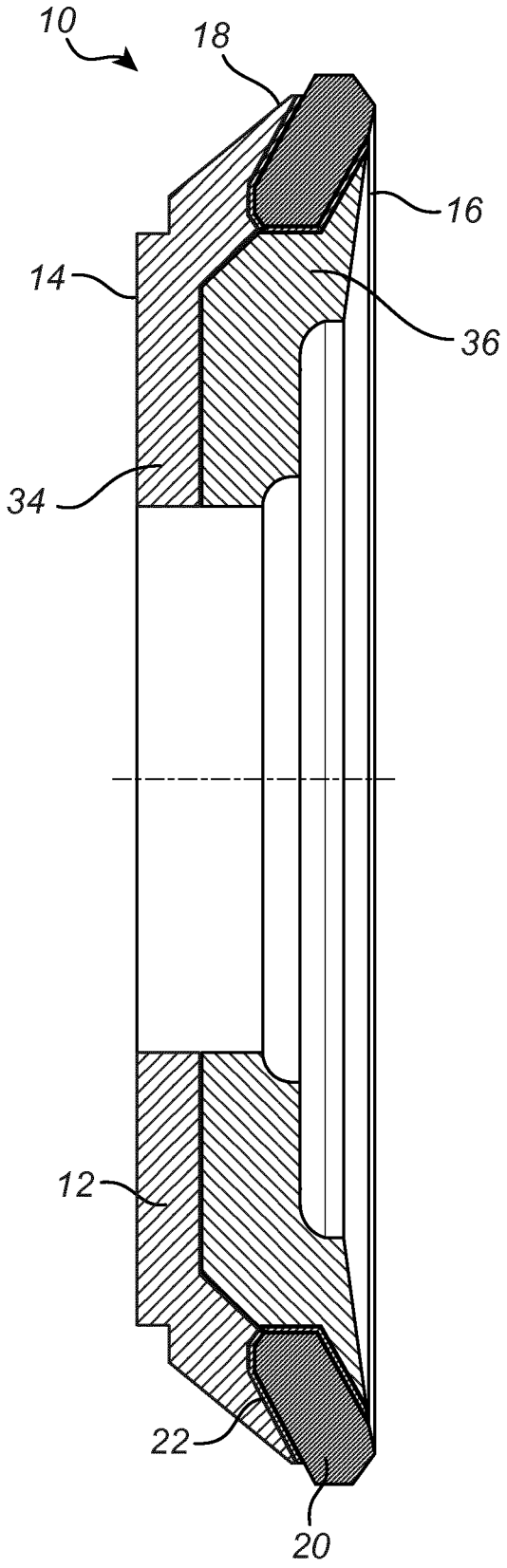

FIG. 10: Cross section view of the disc cutter having two layers to sandwich the continuous ring in-between.

Figure 11:
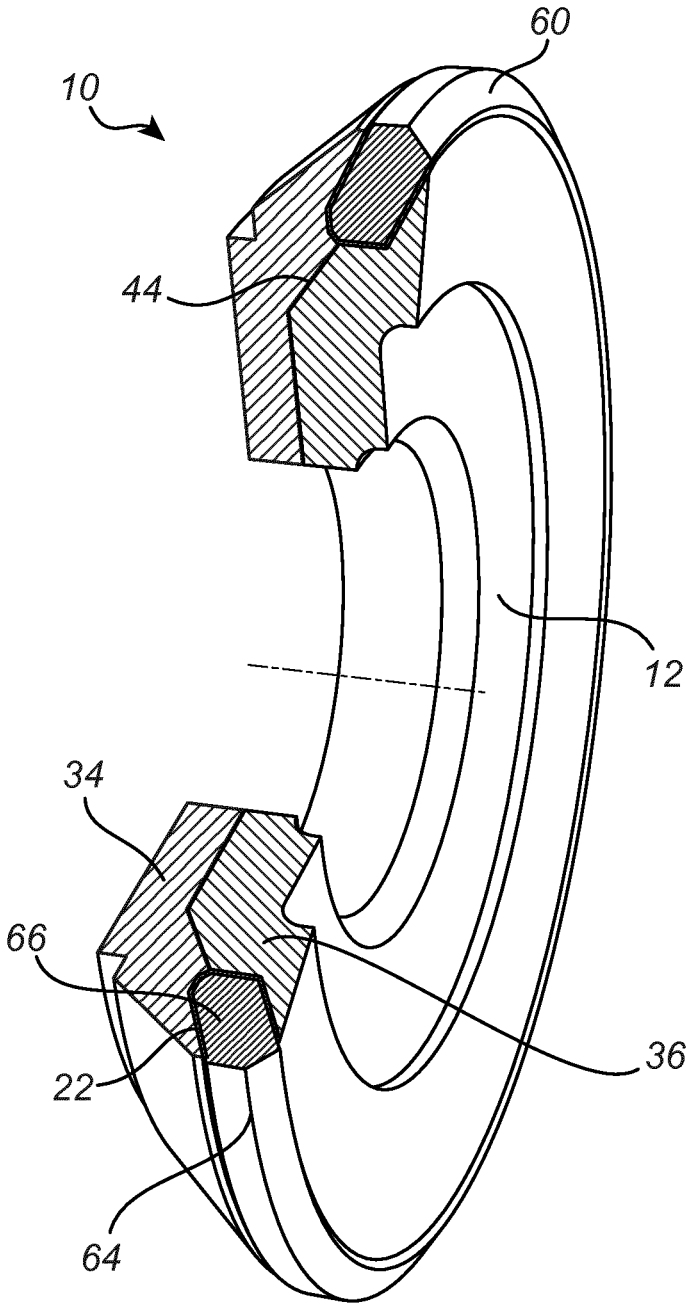

FIG. 11: Perspective view of the disc cutter with a symmetrical continuous ring.

Figure 12:
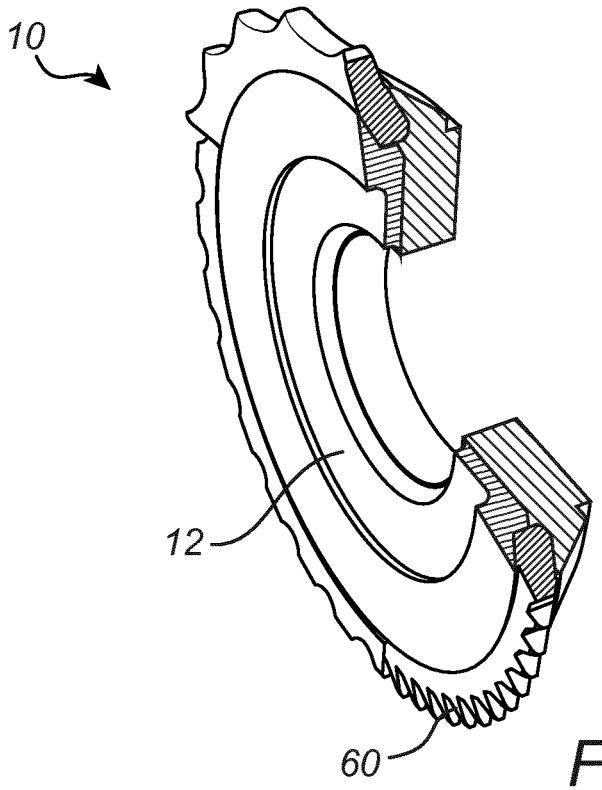

FIG. 12: Perspective view of the disc cutter with an asymmetrical continuous ring.

Figure 13:
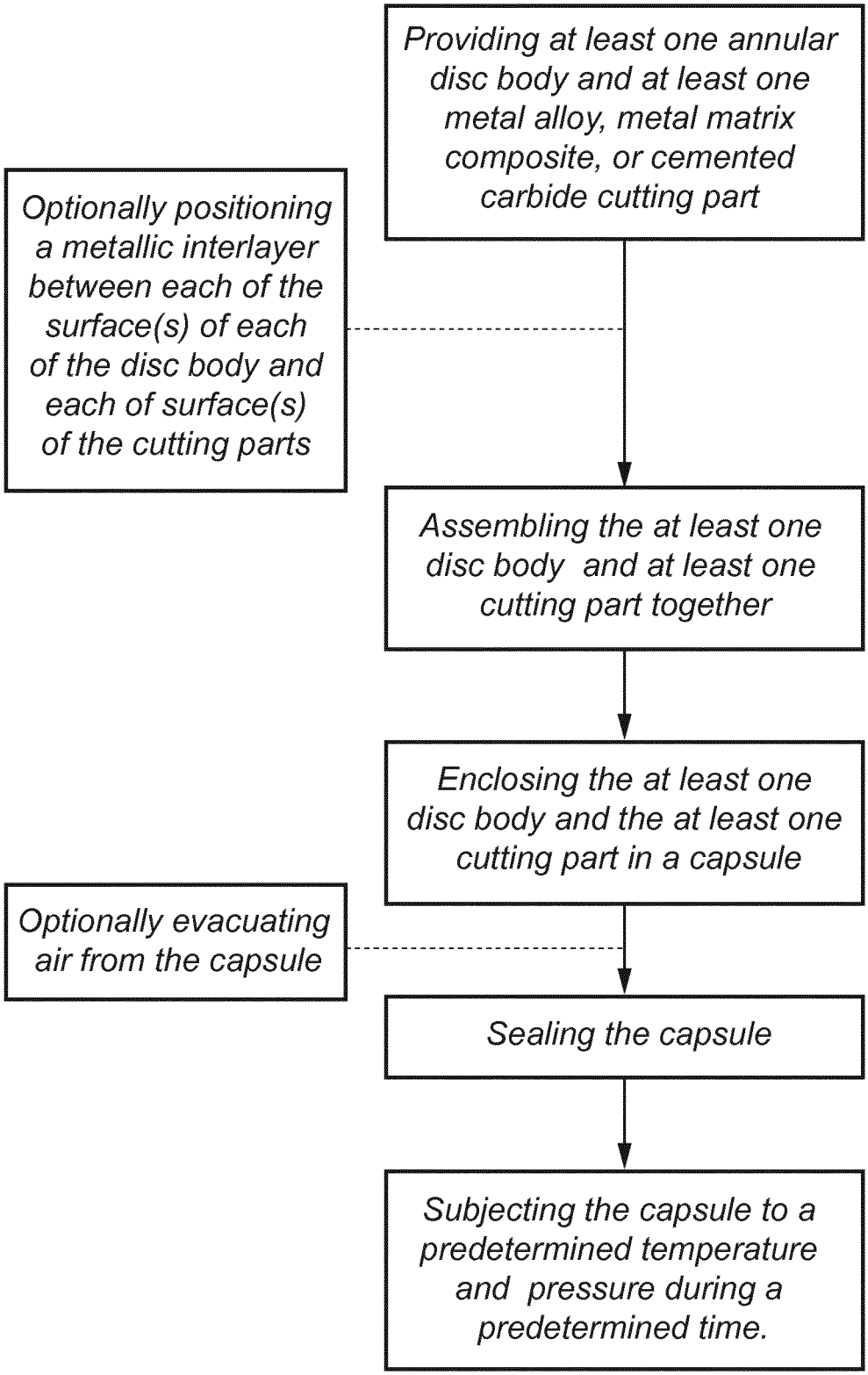

FIG. 13: Flow chart of method.

Figure 14:
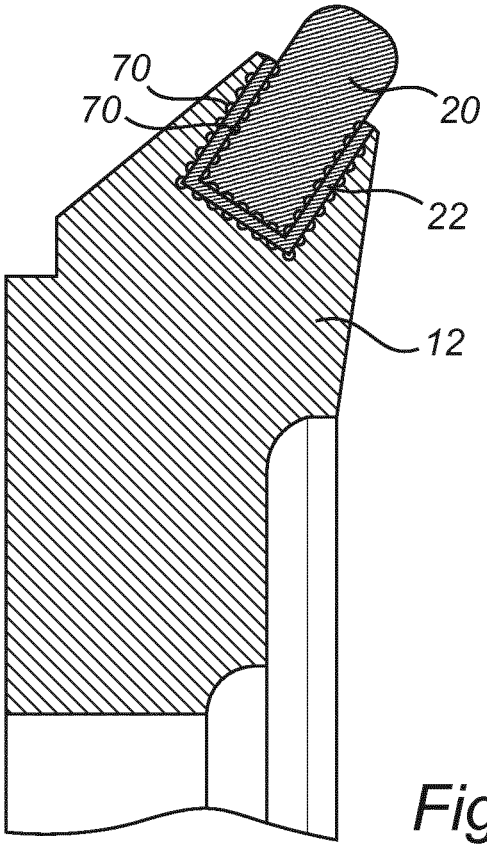

FIG. 14: Cross section of the cutting part having grooves on the surface.

DESCRIPTION

According to one aspect, the present disclosure, as shown in FIGS. 1 and 2, relates to a disc cutter (10) for a cutting unit used in an undercutting application comprising:

an annular disc body (12) made of a metal alloy or metal matrix composite having a first side (14), a second side (16) arranged substantially opposite to the first side (14) and a radially peripheral part (18); and at least one metal alloy, metal matrix composite or cemented carbide cutting part (20) mounted in and substantially encircling the radially peripheral part of the disc body (10) which protrudes outwardly therefrom to engage with the rock during operation;

wherein the at least one cutting part (20) is made from a material having a higher wear resistance than the material used for the disc body (12);

characterized the least one disc body (12) and the at least one cutting part (20), are joined together by diffusion bonds.

The disc cutters (10) are used to excavate material, such as rock, from a rock surface. The disc cutters (10) rotate and the cutting part (20) is pushed against the rock face to fractionate, crush or loosen materials on the rock face. In preferred embodiments the radially peripheral edge (18) of the disc cutter (10) for undercutting operations comprises a sloping annular surface. In preferred embodiments the sloping annular surface slopes inwardly and downwardly towards the central axis of the disc.

In one embodiment, the disc body (12) is made from a metal alloy, preferably a steel alloy. The steel grade may be selected depending on functional requirement of the product to be produced. For example, but not limited to, stainless steel, carbon steel, ferritic steel and martensitic steel. The metal alloy may be a forged and/or a cast body. There is always a trade-off between the hardness and the toughness of the metal alloy selected for disc body and the metal alloy must be selected to have the appropriate balance of these properties for the specific application.

In one embodiment, the disc body (12) is made from a metal matrix composite (MMC). A metal matrix composite is a composite material comprising at least two constituent parts, one part being a metal and the other part being a different metal or another material, such as a ceramic, carbide, or other types of inorganic compounds, which will form the reinforcing part of the MMC. According to one embodiment of the present method as defined hereinabove or hereinafter, the at least one metal matrix composite body (MMC) consists of hard phase particles selected from titanium carbide, tantalum carbide, niobium carbide and/or tungsten carbide and of a metallic binder phase which is selected from cobalt, nickel and/or iron. According to yet another embodiment, the at least one body of MMC consists of hard phase particles of tungsten carbide and a metallic binder of cobalt or nickel or iron or a mixture thereof.

In one embodiment, the at least one cutting part (20) comprises a metal alloy having a higher wear resistance compared to the metal alloy used for the disc body (12).

In one embodiment, the at least one cutting part (20) comprises a cemented carbide. Cemented carbides comprise carbide particles in a metallic binder. According to one embodiment, the cemented carbide cutting part consists of hard phase selected from titanium carbide, titanium nitride, titanium carbonitride, tantalum carbide, niobium carbide, tungsten carbide or a mixture therefore and a metallic binder phase selected from cobalt, nickel, iron or a mixture thereof. Typically, more than 50 wt % of the carbide particles in the cemented carbide are tungsten carbide (WC), such as 75 to 99 wt %, preferably 94 to 82 wt %. According to one embodiment, the cemented carbide cutting part (20) consists of a hard phase comprising more than 75 wt % tungsten carbide and a binder metallic phase of cobalt. The cemented carbide cutting part (20) may be either powder, pre-sintered powder or a sintered body. The cemented carbide cutting part (20) may be manufactured by molding a powder mixture of hard phase and metallic binder and the pressing the powder mixture into a green body. The green body may then be sintered or pre-sintered into a cutting part (20) which is to be used in the present method.

The terms "diffusion bond" or "diffusion bonding" as used herein refers to as a bond obtained through a diffusion bonding process which is a solid-state process capable of bonding similar and dissimilar materials. It operates on the principle of solid-state diffusion, wherein the atoms of two solid, material surfaces intermingle over time under elevated temperature and elevated pressure. The term "substantially encircling" means that the cutting part(s) are in the form of a ring around the peripheral edge (18) of the disc body (12).

FIG. 3 shows one embodiment, wherein there is a metallic interlayer (22) between at the least one disc body (12) and the at least one cutting part (20), the elements of which form the diffusion bonds.

In one embodiment, the metallic interlayer (22) essentially comprises nickel, nickel alloy, copper or copper alloy. A nickel alloy is defined as having at least 50 wt % nickel and a copper alloy is defined as having at least 50 wt % copper.

In one embodiment, the metallic interlayer (22) comprises an alloy essentially consisting of copper and nickel. There will be a difference in carbon activity between the metal alloy or MMC in the disc body (12) and the metal alloy, MMC or cemented carbide in the cutting part (20), as the body comprising cemented carbide will have higher carbon activity which will generate a driving force for migration of carbon from the cemented carbide to the metal. However, experiments have surprisingly shown that by introducing a metallic interlayer (22) comprising an alloy essentially consisting of copper and nickel between or on at least one surface of the disc body and/or at least one cutting part to be HIP:ed, the above-mentioned problems are alleviated. The experiments have shown that the metallic interlayer (22) will provide for that the diffusion of carbon between the disc body (12) and the at least one cutting part (20) will be low due to the low solubility for carbon in the metallic interlayer (22) at the processing temperatures in question, hence the metallic interlayer (22) will be acting as a migration barrier or a choke for the migration of carbon atoms between the metal alloy or of metal matrix alloy in the disc body (12) and the metal alloy, MMC or cemented carbide in the cutting part (20) without impairing the ductility of the diffusion bond between the two parts. This means that the risk that the at least one cutting part (20) will crack during operation and cause failure of the component is reduced.

In one embodiment, the copper content in the interlayer (22) is of from 25 to 98 wt %, preferably from 30 to 90 wt %, most preferably from 50 to 90 wt %. Optionally, rare earth elements could be added to the alloy essentially consisting of copper and nickel.

In one embodiment, the metallic interlayer (22) has a thickness of from about 5 to about 500 μm, preferably from about 100 to about 500 μm.

If the at least one cutting part(s) (20) is made of a metal alloy, the inclusion of the metallic interlayer (22) is optional. If the at least one cutting part(s) (20) is made of the cemented carbide it is preferred that that metallic interlayer (22) is included.

In one embodiment, the at least one cutting part (20) is the form of a plurality of buttons (26) or wear pads (40).

FIG. 4 shows one embodiment, wherein the at least one cutting part (20) is in the form of buttons (26). Preferably, at least some of the buttons (26) have a domed cutting surface (28), and preferably substantially a hemi-spherical cutting surface and a cylindrical mounting part (30). In one embodiment, the disc body (12) includes a plurality of button recesses (24) which are bored into the radially peripheral surface (18) of the disc body (12). Optionally, the metallic interlayer (22) is first placed in each of the button recesses (24) and/or on each of the mounting parts (30) of the buttons (26) and then a button (26) is located in each of the button recesses (24) on top of the metallic interlayer (22). Typically, the buttons (26) are made from cemented carbide. The number of button recesses (24) and buttons (26) used is selected according to the application. The buttons (26) are arranged to abrade rock as the cutting head of the undercutting machine (not shown) rotates. Typically, the disc cutter (10) includes 30 to 50 button recesses (24) and buttons (26). Typically, a greater number of buttons (26) are used for disc cutters having a larger diameter. In preferred embodiments each domed cutting (28) surface sits immediately proud of the peripheral surface (18). That is, each cylindrical mounting part (30) of the button (26) does not protrude beyond the peripheral surface (18), but rather is located within its respective button recess (24). In preferred embodiments an edge (32) that defines where the domed cutting surface (28) meets the cylindrical mounting part (30) is substantially aligned with the peripheral surface (18). In preferred embodiments each cylindrical mounting part (30) substantially fills its respective recess (24). FIG. 5 shows an alternative, wherein the buttons (26) could be fixed in place by inserting the buttons (26) in-between a first layer (34) of the disc body (12) and a second layer (36) of the disc body (12). The first layer (34) and second layer (36) are formed with recesses (24) to hold the buttons (26) in place. The metallic interlayer (22) is optionally placed in each of the button recesses (24) and/or on each of the mounting parts (30) of the buttons (26) and then the first layer (34) and second layer (36) are assembled together with the buttons (26) in-between before being HIP:ed.

Alternatively, the at least one cutting part (20) is in the form of wear pads (40). Preferably, the wear pads (40) are made from cemented carbide. The number of wear pads (40) used is selected according to the application. The wear pads (40) are arranged to abrade rock as the cutting head of the undercutting machine (not shown) rotates. Typically, the shape of the wear pads (40) are as shown in FIG. 6, i.e. they could have been envisaged as wedges which have been radially cut from a ring. The wear pads have a cutting edge (52) which will be in contact with the rock and a mounting part (54) which will join to the disc body (12). The wear pads have a cutting edge (52) which will be in contact with the rock and a mounting part (54) which will join to the disc body (12) and may be either spherically or conically shaped at its largest diameter. The number of wear pads (40) used would be optimised for the given size of the disc cutter and for the specific application. FIG. 6 shows that preferably, the wear pads (40) are arranged such that the neighbouring side of adjacent wear pads (40) are in contact with each other. Consequently, during the HIP process bonds are formed between the adjacent wear pads (40), thus forming a continuous cutting edge.

As shown in FIG. 7 alternatively, gaps (50) could be left between each of the adjacent wear pads (40), thus forming a segmented cutting edge to create point loading effects on the rock as the cutting disc rotates. As shown in FIG. 8, to construct these embodiments the disc body is formed with a circumferal grove (44) formed the peripheral edge (18). Optionally, the intermetallic layer (22) is placed the circumferal grove (44) in the disc body (12) and/or on the mounting part (54) of each of the wear pads (40). The wear pads (40) may be inserted into the circumferal grove (44) formed in the disc body (12). Alternatively, if gaps are to be left between each of the adjacent wear pads (40), recesses could be formed in the peripheral edge (18) of the disc body (12) for the wear pads to be inserted into. Alternatively, the wear pads (40) could be fixed in place by inserting the wear pads (40) in-between a first layer (34) of the disc body (12) and a second layer (36) of the disc body (12), similar to that shown in FIG. 5, with the buttons (26) being replaced by wear pads (40). The first layer (34) and second layer (36) of the disc body (12) are formed with recesses (46) to hold the wear pads (40) in place. If gaps are to be left between each of the adjacent wear pads (40) then at least one of the first layer (34) and/or second layer (36) of the disc body will be formed such that there is a volume of metal alloy or MMC to fill in the gaps and thus, post the HIP process, an integrated unit is formed. Similarly, the metallic interlayer (22) is positioned between the disc body (12) and the wear pads (40) before the HIP process.

FIG. 9 shows one embodiment, wherein the at least one cutting part (20) is in the form of a continuous ring (60). The continuous ring is preferably made from cemented carbide. The continuous ring (60) comprises a sharp peripheral cutting edge (64) and a support part (66) and may be either spherically or conically shaped at its largest diameter. FIG. 9 shows that the support part (66) is enclosed within the circumferal groove (62) of the disc body (12). FIGS. 9 and 10 show that the continuous ring (60) is fixed in place by inserting it in-between a first layer (34) of the disc body (12)

and a second layer (36) of the disc body (12), optionally also with a metallic interlayer (22) positioned between the continuous ring (60) and the disc body (12). At least one of the first layer (34) and/or second layer (36) are formed with a continuous recess (62) to hold the continuous ring (60) in place. After the HIP process the first layer (34), the second layer (36) and the continuous ring (60) join to form an integrated disc cutter (10) having a smooth, uninterrupted cutting edge. The continuous ring (60) could also be mechanically locked into position before the HIP treatment by any other suitable method. The cross section of the continuous ring (60) could be either symmetrical, as shown in FIG. 11 or non-symmetrical, as shown in FIG. 12. The resulting profile of the cutting edge, may either be a smooth as shown in FIG. 11 or oscillating to form a 'cogwheel' shape as shown in FIG. 12. The outer edge of the continuous ring (60) could have different profiles. The ring can also be designed with shape features in the joining surface to improve joining strength and in the rock facing geometry to improve rolling resistance and rock braking.

In one embodiment, the disc body (12) comprises at least two layers, each layer having a different type of metal alloy or metal matrix alloy. As described hereinabove, the disc cutter may comprise a first layer (34), which will form the second side (16) of the disc cutter (10) and a second layer (36), which will form the first side (14) of the disc cutter (10). The first layer (34) and the second layer (36) of the disc body (12) are shaped to be able to hold the at least one cutting part (20) securely in place there in-between. The first layer (34) and the second layer (36) could be made from different materials, for example a higher wear resistant grade of metal alloy or MMC could be used on the side of the disc cutter (10) that is exposed to higher wear rates and the side less exposed to the wear could be made from a cheaper grade of metal alloy or MMC. Post HIP the at least two layers will be joined together to form a unitary body.

Another aspect of the present invention is a method for manufacturing a disc cutter (10) for a cutting unit used in undercutting operations comprising an annular disc body (12) made of a metal alloy or metal matrix composite having a first side (14), a second side (16) arranged substantially opposite to the first side (14) and a radially peripheral part (18); and at least one metal alloy, metal matrix composite or cemented carbide cutting part (20) mounted in and substantially encircling the radially peripheral part (18) of the disc body (12) which protrudes outwardly therefrom to engage with the rock during the undercutting operation; comprising the steps of:

a) providing at least one annular disc body (12) made of a metal alloy or at least one annular body (12) made of a metal matrix composite and at least one metal alloy cutting part (20) or at least one metal matrix composite cutting part (20) or at least one cemented carbide cutting part (20);
b) assembling the at least one disc annular body (12) and at least one cutting part together (20);
c) enclosing the at least one annular disc body (12) and the at least one cutting part (20) in a capsule;
d) optionally evacuating air from the capsule;
e) sealing the capsule;
f) subjecting the capsule to a predetermined temperature of above about 1000° C. and a predetermined pressure of from about 300 bar to about 1500 bar during a predetermined time.

In one embodiment, there is an additional optional extra step between steps a) and b) comprising positioning a metallic interlayer (22) between each of the surface of each of the annular disc body (12) and each of the cutting parts (20). FIG. 13 shows a flow chart for the method.

Steps d) to g) above describe a Hot Isostatic Pressing (HIP) process. HIP is a method which is very suitable for Near Net Shape manufacturing of individual components. In HIP, a capsule which defines the final shape of the component is filled with a metallic powder and subjected to high temperature and pressure whereby the particles of the metallic powder bond metallurgically, voids are closed, and the material is consolidated. The main advantage of the method is that it produces components of final, or close to final, shape having strengths comparable to or better than forged material. The specific advantage of using a HIP method to join the at least one cutting part (20) to the disc body (12) for use as a disc cutter (10) in an undercutting operation is that higher wear resistance and integrity of the joints is achieved.

In the present HIP process, the diffusion bonding of the metal alloy or metal matrix composite disc body (12) and the at least one metal alloy, metal matrix composite or cemented carbide cutting part (20) occurs when the capsule is exposed to the high temperature and high pressure for certain duration of time inside a pressure vessel. The capsule may be a metal capsule which is sealed by means of welding. Alternatively, the capsule may be formed by a glass body. During this HIP treatment, the disc body (12), the cutting part (20) and metallic interlayer (22) are consolidated and a diffusion bond is formed. As the holding time has come to an end, the temperature inside the vessel and consequently also of the consolidate body is returned to room temperature. Diffusion bonds are formed by the elements of the metallic interlayer (22) and the elements of the disc body (12) and the at least one cutting part (20).

The pre-determined temperature applied during the predetermined time may, of course, vary slightly during said period, either because of intentional control thereof or due to unintentional variation. The temperature should be high enough to guarantee a sufficient degree of diffusion bonding within a reasonable time between the disc body and the at least one cutting part. According to the present method, the predetermined temperature is above about 1000° C., such as about 1100 to about 1200° C.

The predetermined pressure applied during said predetermined time may vary either as a result of intentional control thereof or as a result of unintentional variations thereof related to the process. The predetermined pressure will depend on the properties of the disc body (12) and the at least one cutting part (20) to be diffusion bonded.

The time during which the elevated temperature and the elevated pressure are applied is, of course, dependent on the rate of diffusion bonding achieved with the selected temperature and pressure for a specific the disc body (12) geometry, and also, of course, on the properties of the at least one cutting part (20) to be diffusion bonded. Predetermined time ranges are for example from 30 minutes to 10 hours.

In one embodiment of the method, the at least one cutting part (20) comprises a metal alloy.

In one embodiment of the method, the at least one cutting part (20) comprises cemented carbide. In another embodiment the cemented carbide consists of a hard phase comprising titanium carbide, titanium nitride, titanium carbonitride, tantalum carbide, niobium carbide, tungsten carbide or a mixture therefore and a metallic binder phase selected from cobalt, nickel, iron or a mixture thereof.

In one embodiment of the method, the disc body (12) is made of steel.

In one embodiment, the metallic interlayer (22) essentially comprises nickel, nickel alloy, copper or copper alloy.

In one embodiment of the method, the metallic interlayer (22) is formed by an alloy essentially consisting of copper and nickel. The presence of the metallic interlayer (22) will avoid the formation of brittle phases such as $M_6C$-phase (also known as eta-phase) and $W_2C$-phase in the interface between the cemented carbide and the surrounding steel or cast iron. It is important to avoid the formation of such brittle phases as they are prone to cracking easily under load, which may cause detachment of the cemented carbide or the cracks may propagate into the cemented carbide cutting part (20) and cause these to fail with decreased wear resistance of the component as a result. Surprisingly, it has been found that the introduction of the metallic interlayer (22), formed by an alloy essentially consisting of copper and nickel, between or on at least one of the surfaces of the disc body (12) and/or the at least one cutting part (20) that the above problem is alleviated. The metallic interlayer (22) acts as migration barrier or a choke for the migration of carbon atoms between the metal alloy or metal matrix alloy and cemented carbide without impairing the ductility of the diffusion bond in-between. This means that the risk that the at least one cemented carbide cutting part (20) will crack during operation and cause failure of the component is reduced.

According to the present method, the metallic interlayer (20) may be formed from a foil or a powder. However, the application of the metallic interlayer (20) may also be performed by other methods such as thermal spray processes (HVOF, plasma spraying and cold spraying). The metallic interlayer (20) may be applied to: either the surface(s) of the disc body (12) or the surface(s) of the at least one cutting part (20); or on both the surface(s) of the disc body (12) and the at surface(s) of the at least one cutting part (20); or in between the surfaces of the disc body (12) and the at least one cutting part (20). For the parts to be HIP:ed, it is important that there are no areas where the cemented carbide cutting part(s) (20) is in direct contact with the metal alloy or metal matrix composite of the disc body (12). The metallic interlayer (22) may alternatively be applied by electrolytic plating. According to the present disclosure, the copper content of the metallic interlayer (22) is of from 25 to 98 wt %, preferably from 30 to 90 weight % (wt %), more preferably from 50 to 90 wt %. The chosen composition of the metallic interlayer (22) will depend on several parameters such as the HIP cycle plateau temperature and holding time as well as the carbon activity at that temperature of the components to be bonded. According to one embodiment, the metallic interlayer (22) has a about 50 to about 500 μm, such as from 100 to 500 μm. If the metallic interlayer is in the form of a foil, the thickness will typically be between about 50 to about 500 μm. The term "essentially consists" as used herein refers to that the metallic interlayer (22) apart from copper and nickel also may comprise other elements, though only at impurity levels, i.e. less than 3 wt %.

In one embodiment, a plurality of grooves (70) are formed in the surfaces of the at least one cutting part (20) or in the surfaces of both the at least one disc body (12) and the at least one cutting part (20). The inclusion of the grooves (70) increases the surface area between the at least one cutting part (20) and the disc body (12) and thus improves the strength of the joint in-between. The grooves (70) could also be in the form of waves or ridges. This is shown in FIG. 14.

Once the disc cutter (10) has been formed, drill holes are machined into the disc body (12) in order to be able to attach the disc cutter (10) to the undercutting machine (not shown).

It should be understood that any of the embodiments disclosed hereinbefore or hereinafter could be combined together. For example, but not limited to, the application of the metallic interlayer (22), comprising either: essentially nickel, nickel alloy, copper or copper alloy; or comprising an alloy essentially consisting of copper and nickel could be combined with the at least one cutting part (20) comprising cemented carbide. The application of the metallic interlayer (22) as described hereinbefore or hereinafter could be combined with the at least one cutting part (20) being in the form of a plurality of buttons (26) or a plurality of wear pads (40) or being in the form of a continuous cutting ring (60). The application of the metallic interlayer (22) as described hereinbefore or hereinafter could be combined with the disc body (12) having at least two layers. The at least one cutting part (20) being in the form of a plurality of buttons (26) or a plurality of wear pads (40) or being in the form of a continuous cutting ring (60) could be combined with the disc body (12) having at least two layers and/or with the at least cutting part (20) comprising cemented carbide. The addition of the grooves (70) which could be added to the surface(s) of the at least one cutting part (20) or to the surface(s) of both the at least one disc body (12) and to the surface(s) of the at least one cutting part (20) could be combined with the application of the metallic interlayer (22) as described hereinbefore or hereinafter. The addition of the grooves (70) which could be added to the surface(s) of the at least one cutting part (20) or to the surface(s) of both the at least one disc body (12) and to the surface(s) of the at least one cutting part (20) could be combined with the at least one cutting part (20) being in the form of a plurality of buttons (26) or a plurality of wear pads (40) or being in the form of a continuous cutting ring (60).

The invention claimed is:

1. A disc cutter for a cutting unit used in an undercutting apparatus comprising:

at least one annular disc body made of a metal alloy or metal matrix composite having a first side, a second side arranged substantially opposite to the first side and a radially peripheral par; and a cemented carbide cutting part mounted in and substantially encircling the radially peripheral part of the at least one disc body, which protrudes outwardly therefrom to engage with the rock during operation, wherein the cutting part is made from a material having a higher wear resistance than the material used for the at least one disc body, wherein the least one disc body and the cutting part are joined by diffusion bonds, and wherein the cutting part is in the form of a continuous ring positioned between a first layer of the disc body and a second layer of the disc body.

2. The disc cutter according to claim 1, further comprising a metallic interlayer disposed between at the least one disc body and the at least one cutting part, elements of the at least one disc body, at least one cutting part and the metallic interlayer form the diffusion bonds.

3. The disc cutter according to claim 2, wherein the metallic interlayer essentially comprises nickel, nickel alloy, copper or copper alloy.

4. The disc cutter according to claim 2, wherein the metallic interlayer comprises an alloy essentially consisting of copper and nickel.

5. The disc cutter according to claim 2, wherein the metallic interlayer has a thickness of from about 50 to about 500 μm.

6. The disc cutter according to claim 1, wherein the disc body has at least two layers.

7. The disc cutter according to claim 6, wherein the disc body includes a first layer and a second layer, wherein the first layer comprises a metal or metal matrix composite with a higher wear resistance than the second layer.

8. A method of using the disc cutter according to claim 1 for reef mining, rapid mine development systems, oscillating disc cutting or actuated disc cutting.

9. A method for manufacturing a disc cutter for a cutting unit used in an undercutting apparatus the disc cutter including at least one annular disc body made of a metal alloy or metal matrix composite having a first side, a second side arranged substantially opposite to the first side and a radially peripheral part, and a cemented carbide cutting part in the form of a continuous ring mounted in and substantially encircling the radially peripheral part of the at least one disc body which protrudes outwardly there form to engage with the rock during the cutting operation, the continuous ring being positioned between a first layer of the disc body and a second layer of the disc body, the method comprising the steps of:

a) providing at least one annular disc body made of a metal alloy or at least one annular disc body made of a metal matrix composite and a cemented carbide cutting part;

b) assembling the at least one disc body and the cutting part together;

c) enclosing the at least one disc body and the cutting part in a capsule;

d) optionally evacuating air from the capsule;

e) sealing the capsule; and f) subjecting the capsule to a predetermined temperature of above about 1000° C. and a predetermined pressure of from about 300 bar to about 1500 bar during a predetermined time.

10. The method according to claim 9, further comprising an additional step between a) and b) of positioning a metallic interlayer between each of the surface(s) of each of the disc body and each of surface(s) of the cutting parts.

11. The method according to claim 10, wherein the metallic interlayer essentially comprises nickel, nickel alloy, copper or copper alloy.

12. The method according to claim 10, wherein the metallic interlayer is formed by an alloy essentially consisting of copper and nickel.

13. The method according to claim 10, wherein the metallic interlayer is formed from a foil or a powder.

14. The method according to claim 10, wherein the metallic interlayer is formed by electrolytic plating.

15. The method according to claim 10, further comprising adding grooves to the surface(s) of the cutting part or to the surface(s) of both the at least one annular body and to the surface(s) of the cutting part.

* * * * *